US012449229B1

(12) United States Patent
Kempf

(10) Patent No.: US 12,449,229 B1
(45) Date of Patent: Oct. 21, 2025

(54) BOTTOM CHAMBER FIRING REVOLVER

(71) Applicant: James J. Kempf, Coralville, IA (US)

(72) Inventor: James J. Kempf, Coralville, IA (US)

( * ) Notice: Subject to any disclaimer, the term of this patent is extended or adjusted under 35 U.S.C. 154(b) by 0 days.

(21) Appl. No.: 18/211,708

(22) Filed: Jun. 20, 2023

Related U.S. Application Data

(60) Provisional application No. 63/398,348, filed on Aug. 16, 2022.

(51) Int. Cl.
*F41C 3/14* (2006.01)

(52) U.S. Cl.
CPC ..... *F41C 3/14* (2013.01)

(58) Field of Classification Search
CPC ..... F41C 3/14; F41C 3/16; F41C 3/10
See application file for complete search history.

(56) References Cited

U.S. PATENT DOCUMENTS 893,465 A * 7/1908 Durham ..... F41C 3/16 42/40
2,835,171 A * 5/1958 Lyon ..... F41A 9/27 89/157
3,027,673 A * 4/1962 Oliver ..... F41C 3/14 89/157
4,041,633 A * 8/1977 Scrufari ..... F41A 19/22 42/59
4,285,152 A * 8/1981 Dean ..... F41A 9/47 42/62
4,712,466 A * 12/1987 Ghisoni ..... F41A 9/49 89/157
4,899,478 A * 2/1990 Ghisoni ..... F41C 3/14 42/65
4,918,850 A * 4/1990 Rick ..... F41A 3/76 42/59
7,523,578 B2 * 4/2009 Ghisoni ..... F41A 19/52 42/62

OTHER PUBLICATIONS

The Chiappa Rhino Revolver; Ed Buffaloe; 2021; https://unblinkingeye.com/Guns/Rhino/rhino.html (Year: 2021).*
Wheelgun Wednesday: Chiappa Rhino a It's Dangerous Being A Bottom; Nicholas C; Sep. 11, 2010; https://www.thefirearmblog.com/blog/2019/09/11/wheelgun-wednesday-chiappa-rhino-its-dangerous-being-a-bottom/ (Year: 2010).*

* cited by examiner

*Primary Examiner* — Joshua E Freeman
(74) *Attorney, Agent, or Firm* — Donald J. Ersler

(57) ABSTRACT

A revolver having a frame, a cylinder, a trigger assembly, and a barrel. The cylinder is rotatable on its axis and is indexed to position a chamber at the six o'clock position. The barrel is in line with the chamber at the six o'clock position, allowing the revolver to fire a projectile from the six o'clock position, thus causing less barrel rise.

5 Claims, 5 Drawing Sheets

BOTTOM CHAMBER FIRING REVOLVER

CROSS-REFERENCES TO RELATED APPLICATIONS

This is a non-provisional patent application which claims the benefit of provisional patent application No. 63/398,348, filed on Aug. 16, 2022.

BACKGROUND OF THE INVENTION

Field of the Invention

The present invention relates generally to revolvers. The present invention discloses a revolver that allows for reduced barrel jump which results in faster target acquisition on subsequent shots.

Discussion of the Prior Art

Revolvers have historically had a rotatable, or revolving, cylinder that contains multiple radially place chambers for the containment of cartridges of ammunition. Though there have been several design and loading configurations, such as break action, side door, and tilt cylinder, all revolvers have fired the projectile from the chamber into the barrel when the to-be-fired cartridge is in the twelve o'clock position of the rotation of the cylinder. Due to the barrel being higher than the users hand, recoil from the discharge caused the barrel to jump and move the users hand up and back. On small caliber ammunition, recoil was very little, and resulted in very minimal rise of the barrel when the gun was fired. As the caliber size increased, so did the resulting barrel rise. This barrel rise required the user to re-acquire the target for a follow-up shot.

It is more advantageous for the user to have a revolver that has lesser barrel rise when the revolver is fired for easier target re-acquisition on follow-up shots.

SUMMARY OF THE INVENTION

The present invention discloses a revolver that allows for reduced barrel jump which results in faster target acquisition on subsequent shots. The present invention discloses a revolver having a frame, barrel and cylinder that fires a projectile from a chamber through the barrel when the chamber containing the cartridge of ammunition is at the six o'clock position in the rotation of the cylinder, or a bottom chamber firing revolver.

The cylinder has an axis, an axis bore, multiple cartridge bores or chambers evenly space radially about the cylinder axis, and external radially placed indexing detents. In the preferred embodiment, an extractor rod assembly axially to the cylinder axis bore selectively retains the cylinder within the frame, as is known in the industry. The extractor rod assembly includes rods, springs, and a combined extractor plate and ratchet. The extractor plate and ratchet mates with a recess in the back of the cylinder, and is selectively retained by the cylinder wherein they rotate together. The cylinder is rotated by a foot coupled to a trigger and engaged with the ratchet, as known in the art. As the trigger is pulled, the foot advances the ratchet, rotating the cylinder to the next indexing detent. The radially placed indexing detents are positioned to center the to-be-fired chamber bore in the six o'clock position of the rotation of the cylinder.

A trigger mechanism is retained in the frame, and is well known in the arts. Combining springs, levers, slides, sear surfaces and a hammer to activate a firing pin upon completion of the pulling of the trigger. In the preferred embodiment, the revolver has no external hammer. Alternate embodiments may have an external hammer.

A barrel is coupled to the frame, and a bore in the barrel is sized the the caliber of the cartridge. The bore of the barrel is in line with the six o'clock position of to-be-fired chamber of the cylinder.

There are many revolver designs, and many ways of loading and unloading of the chambers of the revolvers. In some revolvers the cylinder is radially fixed within the frame, and a loading gate is used to load and unload the cylinder. Some revolver are break-action, having a hinged frame that rotates the front of the frame and the cylinder forward and down to access the chambers. All of these types of revolvers are alternate embodiments of the invention.

ITEM LIST

Figure 1:
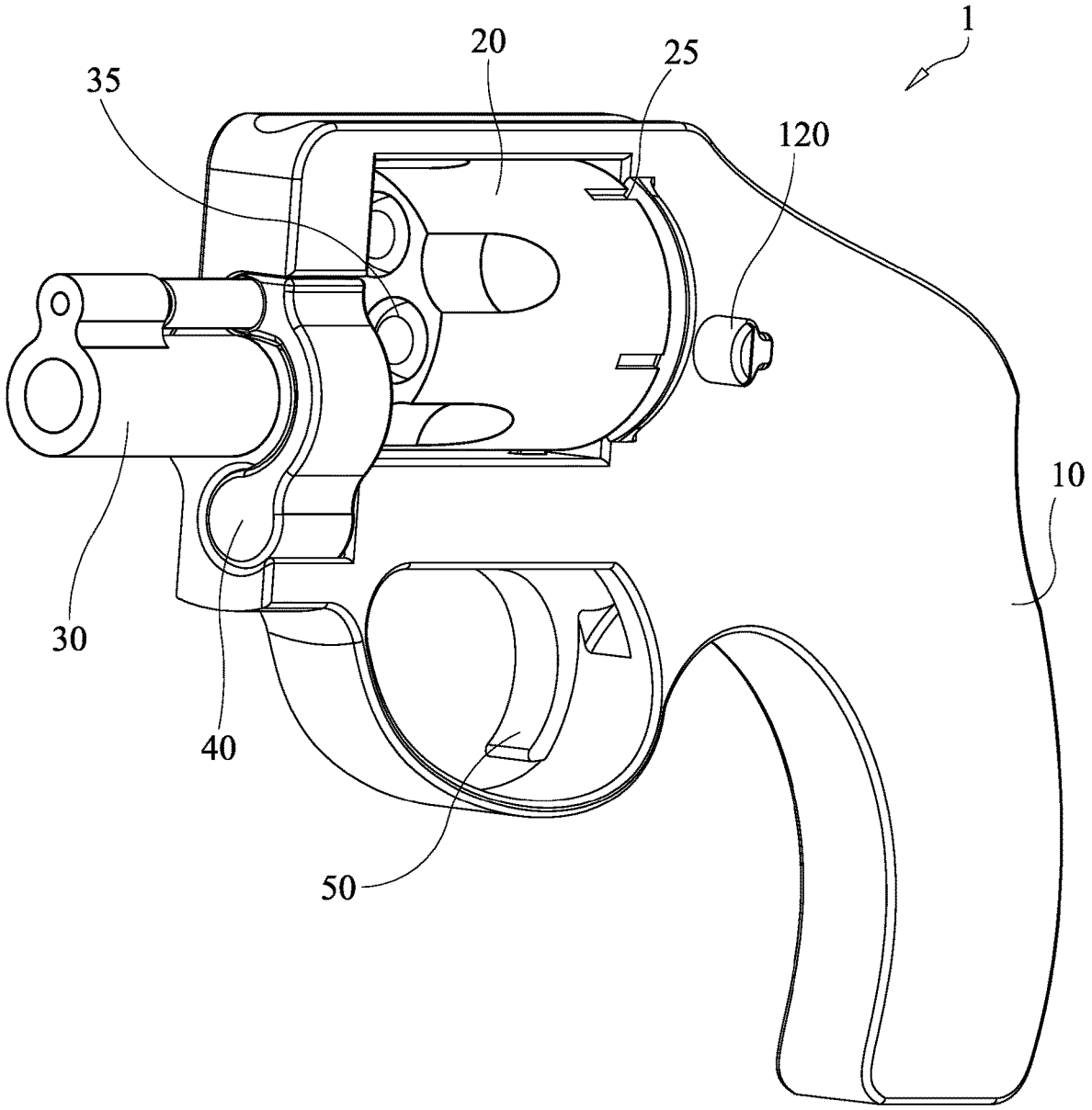
FIG. 1 is a perspective view of a preferred embodiment of a revolver of the present invention where the cylinder is in the closed position.
Figure 2:
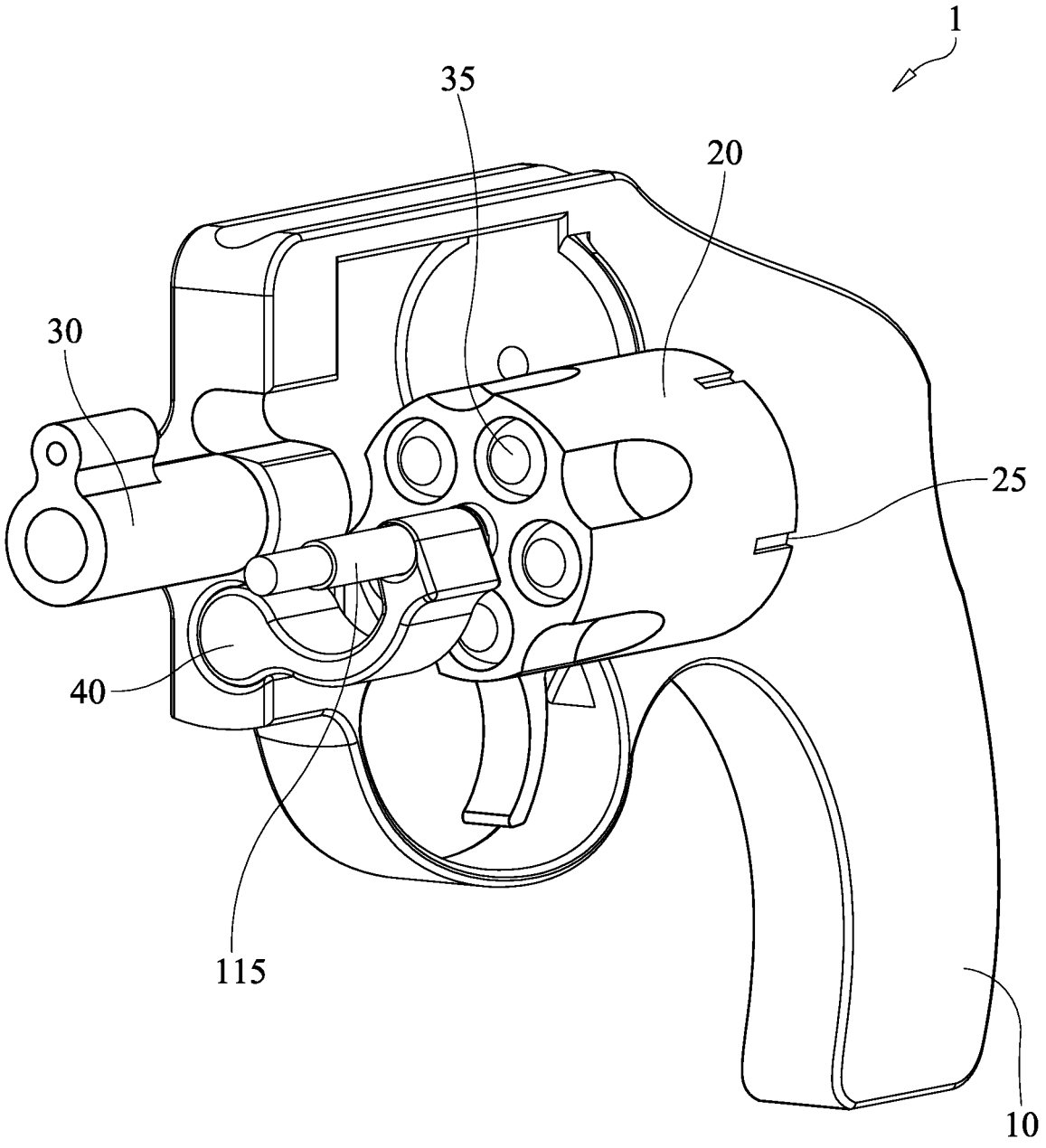
FIG. 2 is a perspective view of a preferred embodiment of a revolver of the present invention where the cylinder is in the open position.
Figure 3:
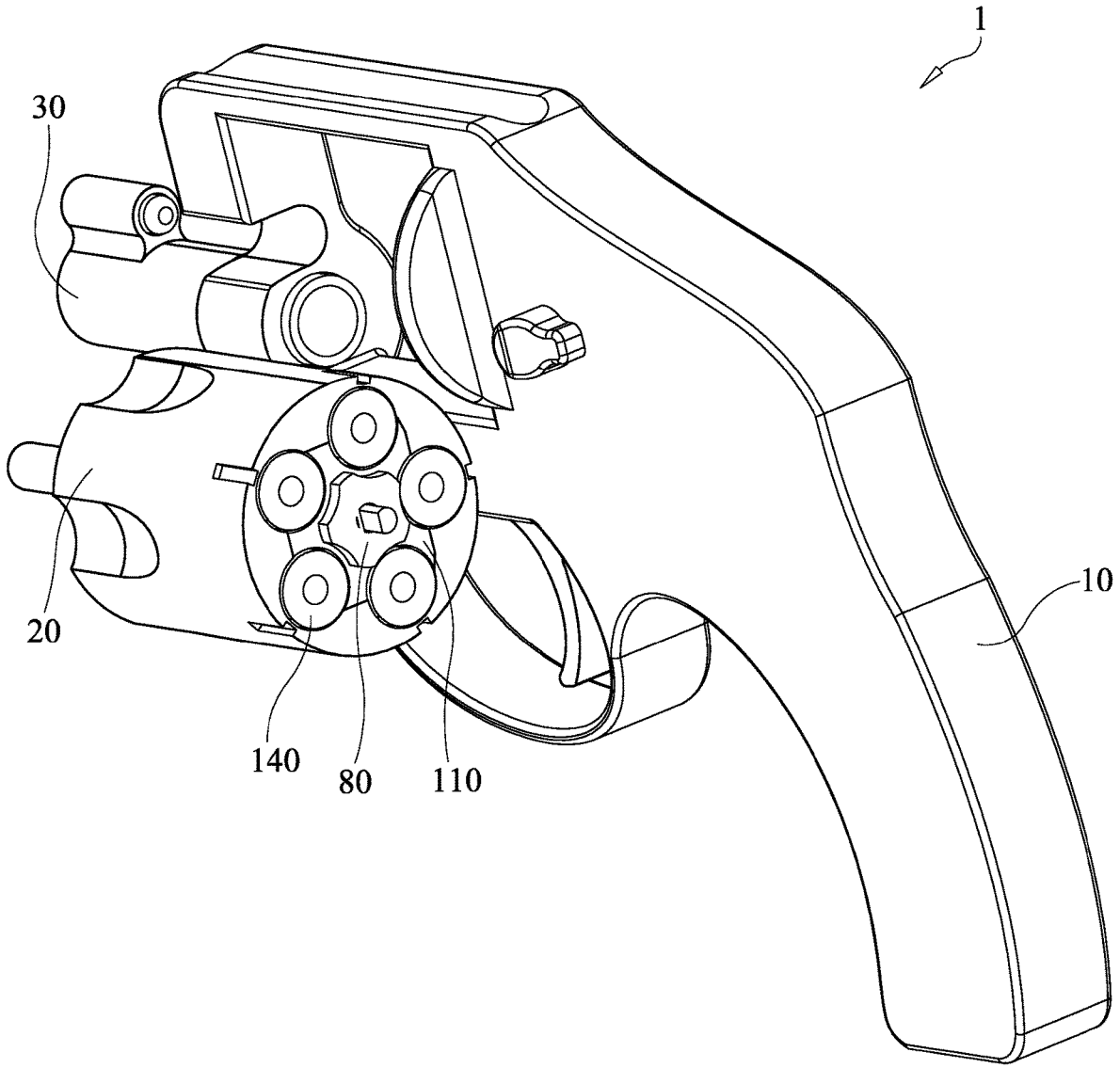
FIG. 3 is a perspective view of a preferred embodiment of a revolver of the present invention where the cylinder is in the open position.
Figure 4:
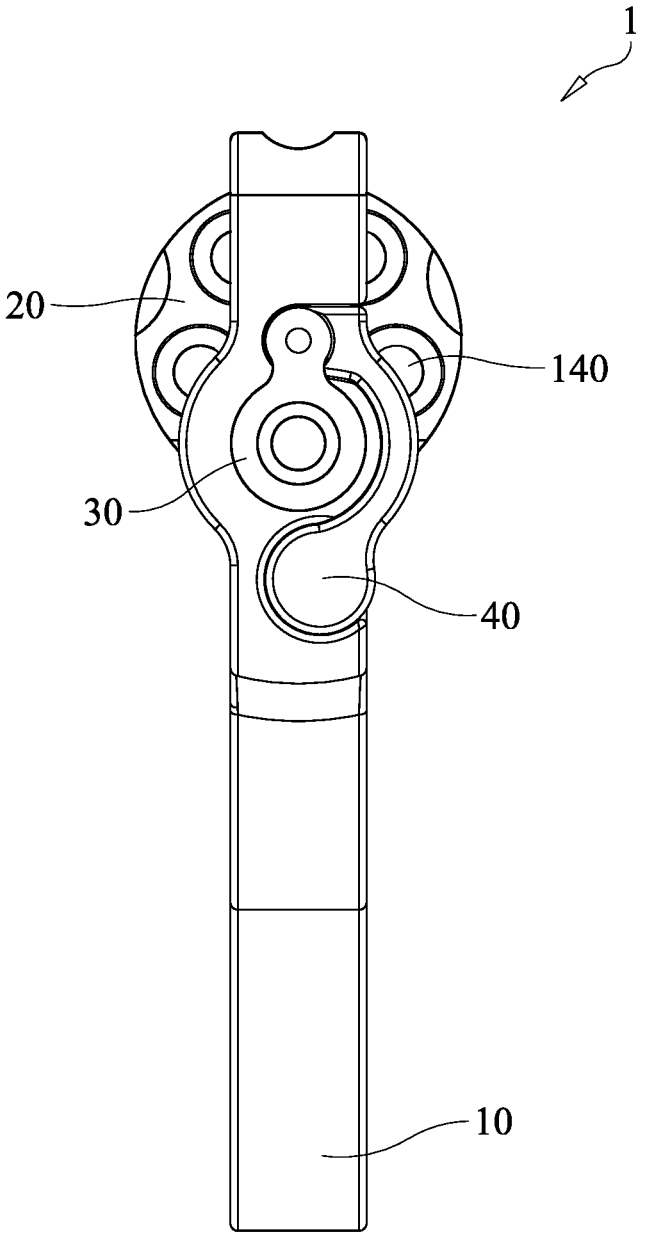
FIG. 4 is a front view of a preferred embodiment of a revolver of the present invention where the cylinder is in the closed position.
Figure 5:
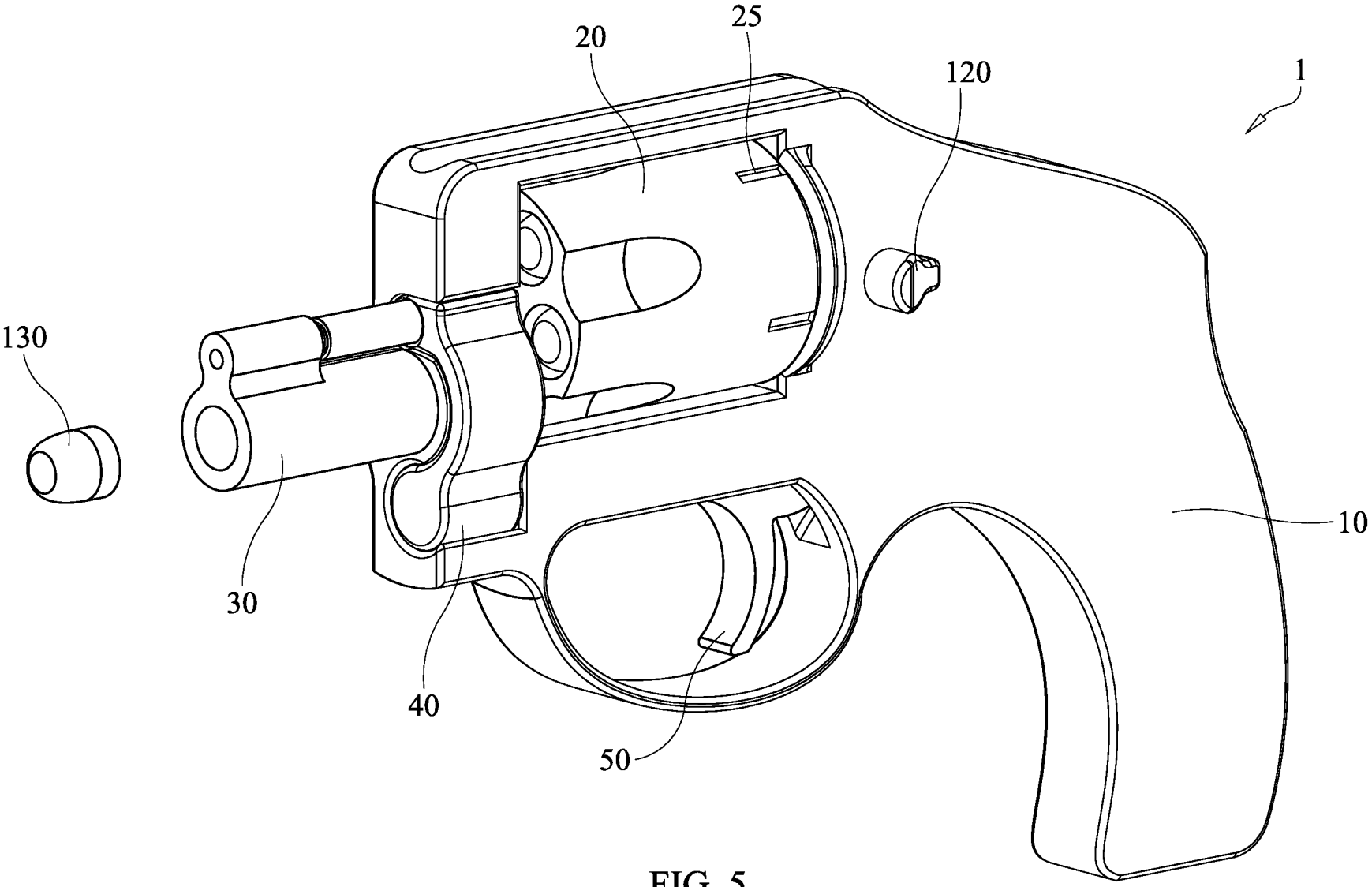
FIG. 5 is a perspective view of a preferred embodiment of a revolver of the present invention where the cylinder is in the closed position and a projectile has just been fired from the muzzle.

1. revolver
10. frame
20. cylinder
25. indexing detent
30. barrel
35. chamber
40. cylinder pivot
50. trigger
60. cartridge bore
70. firing pin
80. ratchet
90. cartridge
100. projectile
110. extractor
115. extractor rod assembly
120. cylinder release
130. projectile
140. cartridge

DETAILED DESCRIPTION OF THE INVENTION

The present invention discloses a revolver having a frame 10, barrel 30, and cylinder 20 that fires a projectile 130 from a chamber 35 through the barrel 30 when the chamber 35 containing the cartridge 140 of ammunition is at the six o'clock position in the rotation of the cylinder 20, or a bottom chamber firing revolver.

The cylinder 20 has an axis, an axis bore, multiple chambers 35 evenly space radially about the cylinder axis, and external radially placed indexing detents 25. An extractor rod assembly 115 axially to the cylinder axis bore selectively retains the cylinder 20 within the frame 10, as is known in the industry. The extractor rod assembly 115 includes rods, springs, and a combined extractor plate 110 and ratchet 80. The extractor plate 110 and ratchet 80 mates with a recess in the back of the cylinder 20, and is selectively retained by the cylinder 20 wherein they rotate together. An axis of the cylinder 20 is rotatably retained on one end of a cylinder pivot 40. An outer perimeter of an opposing end of the cylinder pivot 40 is pivotally retained in the frame 10. A pivot axis of the opposing end of cylinder pivot 40 is located below the barrel 30. The cylinder 20 is rotated by a foot (not shown) coupled to a trigger 50 and engaged with the ratchet 80, as known in the art. As the trigger 20 is pulled, a cylinder stop (not shown) momentarily releases the cylinder 20 by disengaging the indexing detent 25, the foot advances the ratchet 80, rotating the cylinder 20 to allow the cylinder stop to engage the next indexing detent 25. When the cylinder stop is engaging the indexing detent 25, the to-be-fired chamber 35 is in the six o'clock position of the rotation of the cylinder 20.

A trigger assembly (not shown) is retained in the frame 10, and is well known in the arts. Combining springs, levers, slides, sear surfaces and a hammer to activate a firing pin upon completion of the pulling of the trigger 50. In the preferred embodiment, the revolver has no external hammer. Alternate embodiments may have an external hammer.

A barrel 30 is coupled to the frame 10, and a bore in the barrel 30 is sized the the caliber of the cartridge 90. The bore of the barrel 30 is in line with the six o'clock position of to-be-fired chamber 35 of the cylinder 20.

There are many revolver designs, and many ways of loading and unloading of the chambers of the revolvers. In some revolvers the cylinder is radially fixed within the frame, and a loading gate is used to load and unload the cylinder. Some revolver are break-action, having a hinged frame that rotates the front of the frame and the cylinder forward and down to access the chambers. All of these types of revolvers are alternate embodiments of the invention.

I claim:

1. A revolver comprising:

a frame;

a cylinder includes a plurality of chambers, indexing detents, an axis, and an axis bore, said cylinder is rotatably and axially retained in said frame;

an extraction rod assembly including at least one extraction plate and a ratchet, said extraction rod is retained in said cylinder;

a barrel including a bore, said barrel is coupled to said frame;

a cylinder pivot having said cylinder rotatably retained on one end, a circular outer perimeter of an opposing end of said cylinder pivot is pivotally retained in a bore formed in a front of said frame, said extractor rod extends from a front of said cylinder pivot on said one end, a front end of said extractor rod is in contact with a top of said barrel; and a trigger assembly coupled to said frame, said trigger assembly having a trigger, wherein said barrel bore is in alignment with one of said plurality of chambers when one of said plurality of chambers is in a six o'clock position of rotation of said cylinder.

2. A revolver of claim 1, wherein:

said plurality of indexing detents are formed through an end of said cylinder.

3. A revolver of claim 1, wherein:

a pivot axis of said opposing end of said cylinder pivot is located below said barrel.

4. A revolver comprising:

a frame;

a cylinder includes a plurality of chambers, indexing detents, an axis, and an axis bore, said cylinder is rotatably and axially retained in said frame;

an extraction rod assembly including at least one extraction plate and a ratchet, said extraction rod is retained in said cylinder;

a barrel including a bore, said barrel is coupled to said frame, said barrel includes an upper barrel projection extending from a top and front end of said barrel;

a cylinder pivot having said cylinder rotatably retained on one end, an opposing end of said cylinder pivot is pivotally retained in said frame, said extractor rod extends from a front of said cylinder pivot on said one end, a front end of said extractor rod is in contact with a rear of said upper barrel projection; and a trigger assembly coupled to said frame, said trigger assembly having a trigger, wherein said barrel bore is in alignment with one of said plurality of chambers when one of said plurality of chambers is in a six o'clock position of rotation of said cylinder.

5. A revolver comprising:

a frame;

a cylinder includes a plurality of chambers, indexing detents, an axis, and an axis bore, said cylinder is rotatably and axially retained in said frame;

an extraction rod assembly including at least one extraction plate and a ratchet, said extraction rod is retained in said cylinder;

a barrel including a bore, said barrel is coupled to said frame, said barrel includes an upper barrel projection extending from a top and front end of said barrel;

a cylinder pivot having said cylinder rotatably retained on one end, a circular outer perimeter of an opposing end of said cylinder pivot is pivotally retained in a bore formed in a front of said frame, said extractor rod extends from a front of said cylinder pivot on said one end, a front end of said extractor rod is in contact with a rear of said upper barrel projection; and a trigger assembly coupled to said frame, said trigger assembly having a trigger, wherein said barrel bore is in alignment with one of said plurality of chambers when one of said plurality of chambers is in a six o'clock position of rotation of said cylinder.

* * * * *